US005939374A

United States Patent [19]

Richter et al.

[11] Patent Number: 5,939,374

[45] Date of Patent: Aug. 17, 1999

[54] BLOOMING TYPE, HARD SURFACE CLEANING AND/OR DISINFECTING COMPOSITIONS

[75] Inventors: Alan Francis Richter, Branchburg; Frederic Albert Taraschi, Skillman, both of N.J.

[73] Assignee: Reckitt & Colman Inc., Wayne, N.J.

[21] Appl. No.: 08/962,803

[22] Filed: Nov. 3, 1997

Related U.S. Application Data

[63] Continuation of application No. 08/691,212, Aug. 1, 1996, abandoned.

[30] Foreign Application Priority Data

Aug. 4, 1995 [GB] United Kingdom ..... 9516081

[51] Int. Cl.[6] ..... C11D 1/06; C11D 1/62; C11D 1/90

[52] U.S. Cl. ..... 510/384; 510/384; 510/123; 510/124; 510/237; 510/238; 510/245; 510/259; 510/362; 510/363; 510/382; 510/391; 510/398; 510/478; 510/504

[58] Field of Search ..... 510/384, 123, 510/124, 237, 238, 245, 259, 362, 363, 382, 391, 398, 478, 504

[56] References Cited

U.S. PATENT DOCUMENTS

| | | | |
|---|---|---|---|
| 5,629,278 | 5/1997 | Baeck et al. | 510/236 |
| 5,728,667 | 3/1998 | Richter | 510/235 |
| 5,739,092 | 4/1998 | Ofosu-Asante | 510/235 |

*Primary Examiner*—Yogendra Gupta
*Assistant Examiner*—Charles Boyer
*Attorney, Agent, or Firm*—Fish & Richardson P.C.

[57] ABSTRACT

A blooming type, hard surface cleaning concentrate composition includes as a blooming system the following essential constituents: a cationic quaternary ammonium surfactant; an anionic carboxylated alcohol alkoxylate surfactant; a surfactant compatibilizing agent; and, water. Further optional constituents may also be included including additional anionic, cationic, nonionic, amphoteric and zwitterionic surfactants especially to provide a further detersive effect; organic solvents such as alcohols, ethers, glycol ethers to aid in stain solubilization, as well as conventional additves such as coloring agents including dyes, fragrances, and others. In preferred embodiment, the concentrate compositions and cleaning compositions also provide a germicidal effect to hard surfaces. The cleaning concentrates exhibit a charateristic bloom when admixed to a larger volume of water, yet are substantially clear and shelf stable as concentrate compositions.

18 Claims, No Drawings

BLOOMING TYPE, HARD SURFACE CLEANING AND/OR DISINFECTING COMPOSITIONS

This is a continuation of application Ser. No. 08/691,212, filed Aug. 1, 1996, now abandoned.

The present invention relates to improvements in cleaning compositions. More particularly, the present invention is directed to improved hard surface cleaning compositions and concentrates thereof, which feature blooming when the concentrate is added to a larger volume of water.

Cleaning compositions are commercially important products and enjoy a wide field of utility in assisting in the removal of dirt and grime from surfaces, especially those characterized as useful with "hard surfaces". One particular category of cleaning compositions are those which are classed as pine oil type cleaning compositions which typically contain a significant amount, e.g, 5% wt. of naturally derived and/or synthetically produce pine oils. Such compositions generate a milky or cloudy appearance when diluted with water in dilutions useful for cleaning applications, and are generally provided as concentrated composition which is subsequently diluted with water by an end user/consumer to form a cleaning composition therefrom. While such pine oil type cleaning compositions are commercially significant and in popular use, their use is not without attendant shortcomings. For example, high levels of pine oil in a cleaning composition are known to leave undesirable surface residues, particularly on hard surfaces. This effect may be minimized by the addition of further constituents, such as the use of certain surfactants which are useful in solubilizing and stabilizing the the pine oil. However, such a solution raises further problems as many useful surfactants, and frequently the pine oil itself, are categorized as undesired volatile organic compounds ("VOC"). However, the removal of the pine oil itself is not desired nor in most case feasible as its presence is associated with the formation of the blooming effect when the concentrate is added to a larger volume of water. This blooming effect (also sometimes referred to as "break" in the United Kingdom and in other countries) is an important indicia for consumer acceptance for certain products, those which traditionally use pine oil to providing the blooming effect, as well as other products which do not contain pine oil but which nonetheless exhibit this very desirable blooming behaviour when added to a larger volume of water to fomr a cleaning and/or disinfecting composition therefrom.

Various formulations directed to the production of pine oil type cleaners with reduced pine oil content have been proposed. For example, CA 1153267 teaches a pine oil type cleaning composition which includes 0 to 8% by weight pine oil, but which also requires that a minimum of 5.6% by weight alpha terpineol be present. Further, CA 1120820 describes disinfecting pine oil type cleaning composition which includes among other essential constituents, from 5 to 30 percent by weight of pine oil. While advantageous, these compositions as well as other art known compostions and formulations are not without attendant shortcomings, certain shortcomings which the present applicant addresses. The present inventor have also proposed certain pine oil type compositions and concentrates thereof which contain reduced amounts of pine oils in conjunction with certain selected surfactant compositions and other materials which exhibit the desirable characteristics of pine oil type cleaning concentrates, but which have reduced levels of pine oil in their concentrate compositions. These are U.S. Ser. Nos. 08/523,412, and 08/523,413, both filed on Sep. 5, 1995 and commonly assigned with the present application. Notwithstanding the present state of the art, there is yet a need for further improvements to blooming type hard surface cleaning compositions.

In accordance with the present invention, inventors have made the surprising discovery that successful blooming type hard surface cleaners may be produced which do not include pine oil, but which nonetheless exhibits the much desired blooming behaviour which is associated with pine oil cleaners. This surprising discovery now permits for the production of concentrate compositions which are transparent or relatively clear in appearance, but which when added to a greater volume of water such as to form a cleaning/disinfecting composition therefrom, exhibit the blooming behaviour which has hithero been associated with pine oil containing compositions. This discovery permits for the production of cleaning and/or disinfecting compositions and concentrates thereof which contain no pine oil, yet which exhibit this important identifying characteristics of pine oil type cleaning compositions. This discovery also permits for the production of aqeous cleaning and/or disinfecting compositions which exhibit blooming when added to a larger volume of water, but which may be selecteively imparted with any of a number of different appearances and fragracnes which is possible by the judicious selection of any of a number of dyes, fragrances, other colorants which may be added to the concentrate compositions to provide a desired color and a desired scent.

In accordance with their discovery and in accordance with the present inventive teaching there are provided commercially acceptable shelf stable concentrated cleaning and/or disinfecting compositions which exhibit blooming when their concentrated cleaning compositions are diluted with a larger volume of water to form cleaning and/or disinfecting compositions. Such compositions contain no pine oil or pine oil fraction such as a terpineol fraction thereof, or which do not contain pine oil or pine oil fraction such as a terpineol fraction thereof in any significant amount, other than minor amounts such a might be used in a fragrance constituent, as the compositions do not rely upon pine oil or pine oil fractions to provide their blooming characteristic when diluted with water.

In a further aspect of the invention, the present inventors provide processes for the formation for novel blooming type cleaning and/or disinfecting compositions.

In a still further aspect of the invention there are provided processes for cleaning and/or disinfecting hard surfaces by applying effective amounts of a cleaning composition as taught in this specification to a hard surface in need of cleaning and/or disinfection.

The blooming type, aqueous hard surface cleaning and/or disinfecting compositions according to the invention comprise the following essential constituents which form the blooming sytem which is incorporated into the composition:

a cationic quaternary ammonium surfactant;

an anionic carboxylated alcohol alkoxylate surfactant;

a surfactant compatibilizing agent; and, water.

The compositions according to the invention in many cases which comprise any of a number of further optional constituents which do not undesirably reduce or which diminish the operation of the blooming system described herein especially one or more further surfactants including anionic, cationic, nonionic, zwitterionic and/or amphoteric as well as mixtures thereof, one or more organic solvents such as lower alkyl alcohols, lower alkyl diols and glycol ethers, as well as one or more fragrances, coloring agents, chelating agents, germicidal compositions including those based on phenolic compounds, as well as other conventional additives.

These inventive compositions still exhibit many of the desirable characteristics of pine oil type cleaning compositions described above, especially "blooming", but do not require the presence of pine oil to provide the blooming effect. Rather, selected known art dyes or other coloring agents, in conjunction with minor amounts of one or more fragrance materials especially those which provide a pine type scent may be included to the blooming system, as well as further optional surfactants and or organic solvents which are included to provide a detersive property to the compositions. In this way, a cleaning composition which has the physical appearance and blooming characteristic of a conventional pine oil type cleaning composition may be provided without the presence of pine oil. Similarly, other blooming type cleaning and/or disinfecting compositions may be produced such as by including different fragrances, i.e., those characteristic of lemon, various flora, in conjunction with a desired coloring additives, i.e., green, yellow, amber, red, etc. may be added as desired. In each case, a blooming type cleaning and/or disinfecting compositions may produced. "Blooming" may be described as the change of the water's appearance from essentially colorless and transparent to that of a milky white or milky yellowish white, cloudy appearance. Concommitantly, in the concentrate compositions according to the invention, the lack of the overall amounts of pine oil typically found in prior art pine oil type cleaning concentrates, as well as the necessary compatibilizing agents required to solubilize the pine oil in such prior art cleaning concentrate provides the benefits of reduced volatile organic content of a concentrate or cleaning composition, as well as reduce the propensity of such compositions to form undesirable residues, especially pine oil residues upon cleaned surfaces.

The blooming system according to the invention includes at least one cationic quaternary ammonium surfactant; at least one anionic carboxylated alcohol alkoxylate surfactant; at least one surfactant compatibilizing agent which solubilizes the one cationic quaternary ammonium surfactant and the anionic carboxylated alcohol alkoxylate surfactant in a concentrate composition; and, water.

The at least one cationic quaternary ammonium surfactant according to the invention amy be any of those which are known to the art, but preferably are quaternary ammonium compounds and salts thereof include quaternary ammonium germicides which may be characterized by the general structural formula:

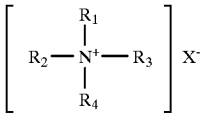

where at least one or $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radicals may be long-chain alkyl, long-chain alkoxy aryl, long-chain alkyl aryl, halogen-substitued long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ether linkages. The radical X may be any salt-forming anionic radical.

Exemplary quarternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quarternary ammonium salts include those in which the molecule contains either amide or ether linkages such as octyl phenoxy ethoxy ethyl dimethyl benzyl ammonium chloride, N-(laurylcocoaminoformylmethyl)pyridinium chloride, and the like. Other very effective types of quarternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quarternary ammonium compounds which act as germicides and which are be found useful in the practice of the present invention include those which have the structural formula:

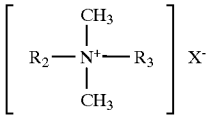

wherein $R_2$ and $R_3$ are the same or different $C_8$–$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or methosulfate. The alkyl groups recited in $R_2$ and $R_3$ may be straight chained or branched, but are preferably substantially linear.

Such quartenary germicides are usually sold as mixtures of two or more different quartenaries, such as BARDAC® 205M, (presently commercially available from Lonza, Inc., Fairlawn, N.J.) which is believed to be a 50% aqueous solution containing 20% by weight of an alkyl dimethyl benzylammonium chloride (50% C14, 40% C16 alkyl); 15% by weight of an octyl decyl dimethylammonium chloride; 7.5% by weight of dioctyl dimethylammonium chloride; and 7.5% by weight of didecyl dimethylammonium chloride. A further useful quarternary germicide is CYNCAL® 80% (presently commercially available from Hilton Davis Chemical Co., Cincinnati, Ohio) which is believed to comprise 80% by weight of an alkyl dimethyl benzylammonium chloride (50% C14, 40% C12 and 10% C16 alkyl), 10% water and 10% ethanol. Further useful quarternary germicidal agents include BTC-8358®, an alkyl benzyl dimethyl ammonium chloride (80% active) and BTC-818®, a dialkyl dimethyl ammonium chloride (both presently commercially available from the Stepan Chemical Co., Chicago, Ill.). Additional suitable commercially available quarternary ammonium germicides of the alkyl dimethyl benzylammonium chloride type containing the same alkyl dimethyl benzylammonium chloride mixture as that of CYNCAL® and which are generally referred to as quarternium salts include BARQUAT® MB-80, (presently commercially available from Lonza, Inc., Fairlawn, N.J.) which is believed to be and 80% by weight solution (20% ethanol) of the quarternary, HYAMINE® 1622 believed to be an aqueous solution of benzethonium chloride, and HYAMINE® 3500, which is believed to be a 50% aqueous solution of the quarternary (both presently commercially available from Lonza Inc., Fairlawn, N.J.).

The cationic surfactant may be present in any amount which are found to exhibit the desirable characteristics of the invention, particularly that of a substantially clear to a relatively clear appearance in concentrated solution, as well as blooming when diluted with further water to form a cleaning composition. In preferred compositions, in addition to the blooming characteristics produced in conjunction with the anionic surfactant and the surfactant compatabilizing agent, the cationic surfactant also exhibits germicidal activity as is noted above.

Generally, this cationic surfactant is present in the concentrate compostions in amounts of 5% by weight and less, preferably in amounts of 0.1–4% by weight, but most preferably in amount of 1–2% by weight. It has been found by the inventors that the preferred amounts are in part dictated by toxocological considerations as an excess of the cationic component may pose an increasing risk of irritation to the eyes, skin and mucocous tissues of a consumer. The preferred amounts are also in part dicated by economic considerations as an excess of the cationic component above these amounts generally requires a corresponding increase in the amount of the anionic component used in the blooming system formed herein.

The at least one anionic carboxylated alcohol alkoxylate surfactant according to the invention is an anionic surfactant which has been found to be effective in forming a water insoluble or poorly miscible complex when mixed with the quaternary ammonium compound described above, which due to said insolubility or poor miscibility of the formed complex, renders an aqueous mixture containing the anionic carboxylated alcohol alkoxylate surfactant and the quaternary ammonium compound such an aqueous mixture turgid, milky or cloudy.

Particularly useful carboxylated alcohol alkoxylate compounds which are advantageously incorporated into the compositions of the invention include carboxylated alcohol alkoxylate surfactants according to the following general formula:

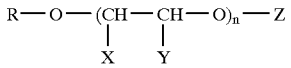

wherein R is a hydrophobic group, more preferably a $C_6$–$C_{18}$ alkyl group, n is a number in the range of 1 to 24, X and Y are independently selected from the group consisting of hydrogen, succinic acid radical, hydroxysuccinic acid radical, citric acid radical, and mixtures thereof, wherein at least one of X or Y is a succinic acid radical, hydroxysuccinic acid radical, or citric acid radical, and Z is H or —$CH_2COOH$. Certain anionic surfactants according to the immediately preceeding general formula are presently commercially available as the Poly-Tergent® C series of anionic surfactants from the Olin Chem. Co., (Stamford, Conn.). Particularly preferred amongst these are the Poly-Tergent™ CS-1 composition which is believed to being a composition according to the formula above wherein R is a $C_6$–$C_{18}$ alkyl group, X and Y are independently H, $CH_3$ or the succinic acid radical with at least one succinic acid radical being present, and where Z is H. Also useful is PolyTergent™ C9-62P a further carboxylated alcohol alkoxylate surfactant also available from the Olin Chemical Co Other known anionic surfactants, while not particularly enumerated here may also find use in the present inventive compositions, as well as mixtures of one or more anionic surfactants.

The carboxylated alcohol alkoxylate is present in any amount which is found to exhibit the desirable characteristics of the invention, that of a relatively clear appearance in an aqueous solution when in the presence of an effective amount of the quaternary ammonium compound described above and further with an effective amount of the surfactant compatiblizing agent described below, but that of blooming when diluted with further water to form a cleaning composition.

Generally, this anionic surface active agent is present in concentrate compostions in amounts of up to about 5% by weight, preferably in amounts of 0.1–5% by weight, but most preferably in amount of between 1 and 3.5% by weight.

Particular attention is to be paid to the relative proportions of the cationic surfactant to the anionic surfactant in the blooming system of the compositions according to the invention, as it is a feature of the invention that both the cationic quaternary ammonium surfactant and the anionic carboxylated alcohol alkoxylate surfactant, and surfactant compatibilizing agent be present in such amounts such that the concentrate composition be relatively clear when present in the concentrate composition. Such a concentrate composition is relatively clear and is preferably transparent. However, upon the addition of the said concentrate composition to a further amount of water, the solubility of these cationic surfactants and the anionic surfactants in the new larger volume of water is sufficinetly reduced or disrupted which causes the newly formed composition to become turgid, or cloudy and thus imitate the "blooming" behaviour of prior art pine oil cleaner type compositions. While not wishing to be bound by any theory, it is hypothesized that in the absence of a sufficient amount of the surfactant compatabilizing agent, the pendant carboxylic acid or carboxylic acid moieties of the preferred species of anionic surfactants effectively complex with the quarternary ammonium in the quarternary ammonium compound and become insoluble or immiscible in an aqueous mixture, which then become visible due to the presence of the sufficiently long alkyl chain moieties which also constitute part of the preferred anionic surfactants. This effect may however be reversed by the addition of an additional, sufficient amount of the surfactant compatibilizing agent to such a mixture, which addition solubilizes at least the anionic surfactant and/or the complexed cationic and anionic surfactants. Such solubilization effectively restores the clear appearance of the aqueous mixture containing the cationic and anionic surfactants. It is contemplated that other anionic surface active agents having a first functional portion or group effective in forming a complex with the quarternary ammonium compound in water, and which has a second functional portion or group which is hydrophobic in nature and which is insoluble or poorly miscible in water when such a complex is formed and in the absence of any further compatabilizing agent(s) become visible to the eye, may also be used.

The surfactant compatibilizing agent which solubilizes the at least one cationic quaternary ammonium surfactant and the at least one anionic carboxylated alcohol alkoxylate surfactant may be any known art material which exhibits the properties described above. Such is beleived to be determinable by routine experimental techniques, such as by providing a volume of water having mixed therein amounts of the cationic quaternary ammonium surfactant compound and the anionic carboxylated alcohol alkoxylate surfactant compound which renders the volume of water to be non-transparent, especially turgid or milky in appearance, and adding thereto an amount of a compound or composition which may be used to compatibilize the anionic and cationic surfactant compounds. Afterwards, an aliquot of this mixture may then be added to a larger volume of water, such as a mixture:water dilution ratio of 1:64 at room temperature (approx. 20° C.) to determine if such mixture evidences a blooming effect.

The inventors have found that one class of such useful surfactant compatibilizing agents are water soluble salts including, but not limited to monovalent alkali and/or polyvalent alkaline earth metal salts and ammonium salts. Non-limiting examples of such useful salts include: NaCl, $MgCl_2$, $NaHCO_3$, $Na_2CO_3$, $NH_4Cl$.

A further class of useful surfactant compatabilizing agents include certain amphoteric surfactants. Useful amphoteric surfactants include betaine compounds which exhibit the following general formula:

$$R-\overset{(+)}{N}(R_1)_2-R_2\overset{(-)}{COO}$$

wherein R is a hydrophobic group selected from the group selected from alkyl groups containing from about 10 to about 22 carbon atoms, preferably from about 12 to about 18 carbon atoms, alkylaryl and arylalkyl groups containing a similar number of carbon atoms with a benzene ring being treated as equivalent to about 2 carbon atoms, and similar structures interrupted by amido or ether linkages; each $R_1$ is an alkyl group containing from 1 to about 3 carbon atoms; and $R_2$ is an alkylene group containing from 1 to about 6 carbon atoms.

Examples of preferred betaines include lauramidopropyl betaine, a commercial preparation of which is available under the tradename Mirataine® BB (from Rhône-Poulenc, Cherry Hill, N.J.), and cocamidopropyl betaine available under the trade name Mackam™ DZ (from McIntyre Group Ltd., University Park, Ill.).

As noted previously, effective amounts of the surfactant compatabilizing agent may be any amount which, when added to the aqueous concentrate mixture of at least one cationic quaternary ammonium surfactant and the at least one anionic carboxylated alcohol alkoxylate surfactant, but do not diminish the blooming characteristic of the concentrate composition when it is added to water. The present inventors have found that in the concentrate compositions according to the invention, such an effective amount may be a relatively small amount, and good compatibilizing behaviour has been observed with amounts of 10% by weight and less, with preferred amounts being 0.01–6% by weight of the compatibilii. While amount less than 6% are to be preferred from an economic standpoint, it is to be understood that other amounts, including those greater than 6% by weight may be necessitated due to the selected cationic surfactant, and anionic surfactant, their relative amounts used, and their miscibility in water.

Water is added to concentrate compositions and in order to provide 100% by weight of the concentrate composition. The water may be tap water, but is preferably distilled and/or deionized water. If the water is tap water, it is preferably appropriately filtered in order to remove any undesirable impurities such as organics or inorganics, especially minerals salts which are present in hard water which may thus interfere with the operation of one or more constituents of the blooming system, as well as any other optional components of the liquid concentrates according to the invention. Water is added in amounts which are sufficient to form the concentrated compositions which amount is sufficient to ensure the retention of a substantially clear characteristic when produced as a concentrate, but at the same time ensuring good blooming upon the addition of the concentrated composition to a further amount of water, or upon the addition of further water to the concentrate. Generally, water is present in the concentrate compostions in amounts in excess of about 50% by weight, preferably in amounts of in excess of 70% by weight, but most preferably in amount of between 80% to 92% by weight of the concentrate compositions according to the invention.

The compositions according to the invention in many cases which comprise any of a number of further optional constituents which do not undesirably reduce or which diminish the operation of the blooming system described herein especially one or more further surfactants including anionic, cationic, nonionic, zwitterionic and/or amphoteric as well as mixtures thereof, one or more organic solvents such as lower alkyl alcohols, lower alkyl diols and glycol ethers, as well as one or more fragrances, coloring agents, chelating agents, antioxidants, germicidal compositions including those based on phenolic compounds, as well as other conventional additives. Such further optional constituents may be included in amounts found not to substantially interfere or detract from the blooming characteristics provided by the invention. Such materials are known to the art, and are described in *McCutcheon's Emulsifiers and Detergents* (*Vol.* 1), *McCutcheon's Functional Materials* (*Vol.* 2), North American Edition, 1991; *Kirk-Othmer, Encyclopedia of Chemical Technology,* 3rd Ed., Vol. 22, the contents of which are herein incorporated by reference.

Known surfactants which provide a further detersive effect to the concentrate compositions and especially to the cleaning compositions formed therefrom may be where such do not substantially interfere or detract from the blooming characteristics provided by the invention, and further desirably do diminish the germicial nature of the preferred cationic quaternary ammonium compounds which are included in the blooming system being taught herein. Such include anionic, cationic, nonionic, zwitterionic and/or amphoteric as well as mixtures thereof.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain. Especially valuable are linear straight chain alkylbenzene sulfonates in which the average number of carbon atoms in the alkyl group is from about 11 to 14.

Other anionic surfactants herein are the water soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water soluble salts of esters of α-sulfonated fatty acids containing from about 0 to 20 carbon atoms in the fatty acid group and from about 1 to 10 carbon atoms in the ester group; water soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Care should be exercised however in the selection of the anionic surfactants as it is known to the art that many anionic form insoluble complexes with cationic quaternary ammonium surfactants, and their use in most cases is to be limited to minor amounts or wholly avoided.

Useful nonionic surfactants which may be included in the concentrate compositions include known art nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic surfactant compound. Further, the length of the polyethenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

To be mentioned as particuarly useful nonionic surfactants are alkoxylated linear primary and secondary alcohols such as those commercially available under the tradenames PolyTergent® SL series (Olin Chemical Co., Stamford Conn.), Neodol® series (Shell Chemical Co., Houston Tex.); as alkoxylated alkyl phenols including those commercially available under the tradename Triton® X series (Union Carbide Chem. Co., Danbury Conn.).

Known organic solvents which may be useful in providing a further cleaning benefit, especially in the loosening of stains may be added to the concentrate compositions of the invention. Such should be selected and be present in amounts which do not substantially interfere or detract from the blooming characteristics provided by the invention. Exemplary organic solvents include lower alkyl alcohols, lower alkyl diols and glycol ethers.

Lower alkyl alcohols which may be included are generally the water soluble $C_1$–$C_8$ alchols as well as the water miscible $C_1$–$C_8$ diols examples of which include methanol, ethanol, propanol, isopropanol, butanol including t-butanol.

Exemplary glycol ethers water miscible glycol ethers including those having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Preferred are glycol ethers having one to five glycol monomer units. These are $C_3$–$C_{20}$ glycol ethers. Examples of more preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Further useful as the organic solvent are water-miscible ethers such as. diethylene glycol diethylether, diethylene glycol dimethylether, propylent glycol dimethylether, as well as lower esters of monoalkylethers of ethyleneglycol or propylene glycol such as. propylene glycol monomethyl ether acetate. Such are commercially available from Union Carbide, Dow Chemicals or Hoescht. Mixtures of organic solvents can also be used.

An optional, but sometimes desirable composition which may be added to the concentrate composition according to the invention is pine oil. Pine oil is a complex blend of oils, alcohols, acids, esters, aldehydes and other organic compounds, and is sometimes used as a solvent for certain types of stains. An important constituent of pine oil are terpene alcohols, especially alpha-terpineol. When included, the pine oil generally comprises at least about 60% terpene alcohols, especially alpha-terpineol. Particularly effective presently commercially available pine oils Glidco® Pine Oil™ 60 (available from Glidco Organics Corp., Jacksonville, Fla., believed to contain approximately 60% terpene alcohols), Glidco® Pine Oil 60 (available from Glidco Organics Corp., Jacksonville, Fla., believed to contain approximately 60% terpene alcohols); Glidco® Pine Oil 140 (available from Glidco Organics Corp., Jacksonville, Fla., believed to contain approximately 70% terpene alcohols); Glidco® Pine Oil 80 (available from Glidco Organics Corp., Jacksonville, Fla., believed to contain approximately 80% terpene alcohols) Glidco® Pine Oil 150 (available from Glidco Organics Corp., Jacksonville, Fla., believed to contain approximately 85% terpene alcohols); Glidco® Terpene SW (available from Glidco Organics Corp., Jacksonville, Fla., believed to contain approximately 75% terpene alcohols); as well as Glidco® Terpineol 350 (available from Glidco Organics Corp., Jacksonville, Fla., believed to contain approximately 100% terpene alcohols). Other products which can contain up to 100% pure alpha-terpineol, may also be used in the present invention.

When included, the pine oil constituent need be present in only minor amounts as they are not required to produce the blooming characteristics of the inventive compositions. Generally, they are present in reduced amounts in the concentrate compostions, i.e., in amounts of up to about 3% by weight, and if present are preferably included in amounts of from 0.01–2.5% by weight, but most preferably in amount of between 0.75–1.5% pine oil by weight. As with all of the weight percentages of the constituents described, the weight percentages are indicative of the weight percentages of the actives in a constituent containing preparation.

A further optional, but in some cases advantageous organic solvent which may be included are one or more terpene solvents, especially monocyclic monoterpene and bicyclic terpenes which include terpinene, terpinolenes, limonenes, pinenes and mixtures thereof. Some may be found in fractions of pine oils noted above, but preferred are those which may be obtained from the essence of citrus fruits of various types including from oranges, lemons and grapefruit. These are generally mixtures which include one or more of the following: d-limonene, dipentene, alpha-pentene, beta-pinene of which d-limonene is most preferred and may for example be obtained by distilling orange rind oil. Such a material is readily commercially available, has a very pleasant citrus fragrance, is known to have favorable cleaning properties and is derived from a naturally occuring material. If present such materials, especially materials which comprise 90% wt. and greater of d-limonene, need be present in only minor amounts, i.e., about 5% wt. and less, and generally about 3% wt. and less of the concentrate composition.

Certain of the optional constituents, such as the derivatives of citrus fruit may be provided with, or benefit from the addition of minor amounts of a stabilizer such as an antioxidant material, such as butylated hydroxytoluene.

Certain of the optional constituent, such as pine oil if included, may require a solubilizing adjuvant such as certain nonionic alkoxylated linear alcohol surfactants which aid in the dissolution of the pine oil in the water of the concentrate composition. Such useful nonionic alkoxylated linear alcohol nonionic surfactants are known, and may be commercially obtained from the Olin Chemical Co., (Stamford, Conn.) under the product line name of "Poly-Tergent®". Particular members of this product line which have been found useful include; Poly-Tergent® SL-42 and Poly-Tergent® SL-62. Further useful nonionic surfactants include alkoxylated linear secondary alcohols, as well as alkoxylated alkylphenolic nonionic surfactants. Such nonionic surfactants also provide a detersive effect to the compositions.

Further exemplary pine oil solubilizing agents include $C_1$–$C_8$ alcohols, especially $C_1$–$C_3$ alcohols, of which isopropanol is preferred. An advantage of such alcohols is in providing a further overall cleaning, i.e., stain solublizing effect to the compostiions.

It has generally been found that due to the relatively small amounts of the pine oil which are contemplated as optional constituents in the inventive compositions would generally require a concommitantly small amount of the pine oil solubilizing agent, i.e., solubilizing adjuvant. Pine oil solubilizing agent in amounts of 15% by weight and less have been found to be effective to solubilize the pine oil, as well as optionally solubilizing other constituents which may be present in the concentrate compositions of the invention. Preferably, if present, such a pine oil solubilizing agent in amounts of 15% and less by weight, preferably 0.01–10% by weight, and most preferably 0.1–5% by weight are used in the concentrate compositions.

Further optional, but desirable constituent include fragrances, natural or synthetically produced containing synthetic fragrance compositions, especially those which are intended to mimic the scent of one or more resins or oils derived from coniferous species of trees, viz., a scent characteristic of pine oil type cleaning concentrates as well as scents characteristic of other forms of flora, such as flowers. Other desired fragrance materials may also be included in the compositions, and such are generally included in minor amounts, i.e, less than about 5% wt. of a concentrate compositions and care should be exercized so as not to undesirably inhibit the operation of the blooming system according to the invention and as described above. Many organic materials which providing a fragrancing effect may be used and these include those described at columns 9–11 of U.S. Pat. No. 5,336,445 the contents of which are herein incorporated by reference. Such fragrances may be added in any conventional manner, admixing to a concentrate composition or blending with other constituents used to form a concentrate composition, in amounts which are found to be useful to enhance or impart the desired scent characteristic to the concentrate composition, and/or to cleaning compositions formed therefrom.

Further optional, but advantageously included constituents are one or more coloring agents which find use in modifying the appearance of the concentrate compositions and enhance their appearance from the perspective of a consumer or other end user. Known coloring agents, may be incorporated in the compostions in effective amount to improve or impart to concentrate compositions an appearance characteristic of a pine oil type concentrate composition, such as a color ranging from colorless to a deep amber, deep amber yellow or deep amber reddish color. Other coloring agents, such as those which may impart a yellow color, such as may be associated with a lemon colored cleaning composition, or other colors may also be included. Such a coloring agent or coloring agents may be added in any useful amount in a conventional fashion, i.e., admixing to a concentrate composition or blending with other constituents used to form a concentrate composition.

Still further conventional additives which may be included are one or more hydrotopes such as sodium toluene sulfonate and sodium cumene sulfonate; one or more antibacterial agents such as orthobenzyl-para-chlorophenol although in preferred embodiments wherein the cationic quaternary ammonium compound has germicidal activity a further antibacterial agent is not normally required, detergent builder compositions, chelating agent especially useful as hard water ion sequestrants, as well as others. Each of such materials is generally only included in very minor amounts, i.e., each generally not exceeding 0.15% wt of the concentrate composition, but desirably even less.

Generally the total weight of such further conventional additives may comprise up to 30% by weight of a concentrated composition formulation.

What is to be understood by the term "concentrate" and "concentrate composition" in this specification and claims is the pre-consumer dilution and composition of the cleaning composition which is the essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surfaces.

As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured amounts of the concentrate compositions in water by the consumer or other end user in certain weight ratios of concentrate:water, and optionally, agitating the same to ensure even distribution of the concentrate in the water. As noted, the concentrate may be used without dilution, i.e., in concentrate:water concentrations of 1:0, to extremely dilute dilutions such as 1:10,000. Desirably, the concentrate is diluted in the range of 1:0.1–1:1000, preferably in the range of 1:1–1:500 but most preferably in the range of 1:10–1:100. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the concentrate in water.

EXAMPLES FORMULATIONS

Preparation of Example Formulations

Exemplary formulations according to the instant invention were prepared in accordance with the following general procedure.

Into a suitably sized vessel, the following constituents were added in the sequence: water, cationic and anionic surfactant compositions of the blooming system, the sufactant compatibilizing agent, and then any remaining constituents. All of the constituents were supplied at room temperature, and mixing of the constituents was achieved by the use of a magnetic stirrer. These constituents were used "as is" as supplied from their respective supplier. Mixing, which generally lasted from 1 minute to 5 minutes, was maintained until the particular exemplary formulation attained uniform color and uniform clarity. The exemplary compositions were readily pourable, and retained well mixed characteristics indicative of stability.

The exact compositions of the example formulations are listed on Table 1, below.

TABLE 1

EXAMPLE FORMULATIONS

| | Example Formulation: (in % weight) | | |
|---|---|---|---|
| Constituent: | Ex. 1 | Ex. 2 | Ex. 3 |
| PolyTergent ® CS-1 | 3.0 | 6.0 | — |
| PolyTergent ® C9-62P | — | — | 4.0 |
| BTC-8358 | 3.0 | — | — |
| BTC-818 | — | 6.0 | 4.2 |
| sodium chloride | 2.0 | — | — |
| Mackam ® DZ | — | 5.6 | 11.4 |
| PolyTergent ® SL-42 | — | 1.25 | — |
| deionized water | to 100 | to 100 | to 100 |

PolyTergent ® CS-1 is a polycarboxylated alcohol alkoxylate (50% active) available from Olin Chemical Corp.
PolyTergent ® C9-62P is a polycarboxylated alcohol alkoxylate (50% active) available from Olin Chemical Corp.
BTC-835 is an alkyl benzyl dimethyl ammonium chloride (53% active) available from Stepan Chemical Co.
BTC-818 is a dialkyl dimethyl ammonium chloride (50% active) available from Stepan Chemical Co.
Mackram ® DZ is cocoamidopropyl betaine (30% active) available from McIntyre Group Ltd.
Poly-Tergent ® SL-42 is a nonionic alcohol alkoxylate available from Olin Chemical Corp.

Evaluation of Example Formulations

Each of the example formulations was used to prepare an aqueous diluted form therefrom of a concentration and dilution typical of conventionally used cleaning compositions useful in commercial/residential locations. These aqueous dilutions were simply prepared by pouring one part by weight of each example formulation of Table 1 into 63 parts by weight of tap water (1:64 by weight dilution) at 20° C. and at 40° C.

In each case, the addition of an example formulation to the water was accompanied by a change in the appearance of the water from transparent to a translucent cloudy, whitish appearance.

These aqueous dilutions were prepared to evaluate the degree of light transmittance, a measure of the opacity as well as of the blooming of each of the aqueous dilutions. Certain of these aqueous dilutions were also evaluated to determine the antimicrobal efficacy of the aqueous dilution. The results of the light transmittance evaluation was determined as a percentage of light transmitted through a sample of a particular aqueous dilution wherein the transmisson of a like sample of water is assigned a percentage of 100%. Testing was performed by mixing a 5 g aliquot of a particular example formulation with 315 g of tap water (with approx. 100 ppm hardness), after which the sample was mixed for 60 seconds and a transmittance reading at 620 nm wavelength was taken using a Brinkman model PC801 dipping probe calorimeter, which was set at 620 nm to determine the light transmission of eash of the samples. Samples of each formulation at 20° C. and at 40° C. were evaluated, as well as the reference (pure tap water) sample used to calibrate the colorimeter to the reference 100% light transmission sample outlined above. The resulting determined values, reported as "Blooming" in Table 2 below provide an empirical evaluation, reported in percent transmittance ("%") of the degree of transparency of a diluted example formulation wherein 0% indicates complete opacity and 100% the transparency of a water sample as noted above. Accordingly, those results indicative of lower transmittance values identify samples exhibiting desirable turgid or cloudy appearances.

TABLE 2

TEST RESULTS OF TABLE 1 FORMULATIONS

| | Blooming |
|---|---|
| Dilution of Example Formulation: | transmission at 20° C. |
| Ex. 1 | 9.2% |
| Ex. 2 | 9.7% |
| Ex. 3 | 19.7% |

As can be seen from the results reported above, the exemplary formulations featured good blooming behaviour as cleaning composition, but were substantially clear in the form of concentrate compositions.

We claim:

1. An aqueous blooming type, hard surface cleaning composition concentrate which comprises a blooming system which includes the following essential constituents:

a cationic quarternary ammonium compound according to the structure:

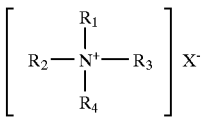

wherein:

at least one or $R_1$, $R_2$, $R_3$ and $R_4$ is selected from hydrophobic, aliphatic, aryl aliphatic or aliphatic aryl radical of from 6 to 26 carbon atoms, and any remaining $R_1$, $R_2$, $R_3$ and $R_4$ are hydrocarbons of from 1 to 12 carbon atoms, wherein any of $R_1$, $R_2$, $R_3$ and $R_4$ may be linear or branched and may include one or more ether or amide linkages; and, X is a salt-forming anionic radical;

a carboxylated alcohol alkoxylate surfactant compound is one according to the following general formula:

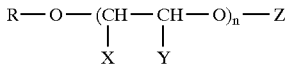

wherein:

R is a hydrophobic $C_6$–$C_{18}$ alkyl group, n is 1–24,

X and Y are independently selected from the group consisting of hydrogen, $CH_3$ succinic acid radical, hydroxy succinic acid radical, citric acid radical, and mixtures thereof, wherein at least X or Y is a succinic acid radical, hydroxy succinic acid radical, citric acid radical, and Z is H or —$CH_2COOH$;

a surfactant compatibilizing agent selected from monovalent alkali earth metal salts, polyvalent alkali earth metal salts, ammonium salts, and amphoteric betaine surfactants; and, water, characterized in that when 1 part of the said composition concentrate is mixed with 63 parts of water at 20° C., one minute after mixing the resultant composition exhibits a light transmittance of 19.7% or less.

2. The composition according to claim 1 wherein the cationic quaternary ammonium surfactant exhibits germicidal activity.

3. The composition according to claim 1 wherein:

the cationic quaternary ammonium compound is one according to the structure:

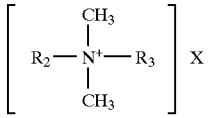

wherein $R_2$ and $R_3$ are the same or different $C_8$–$C_{12}$alkyl, or $R_2$ is $C_{12-16}$alkyl, $C_{8-18}$alkylethoxy, or $C_{8-18}$alkylphenolethoxy and $R_3$ is benzyl and X is a halide or methosulfate.

4. The composition according to claim 1 wherein the cationic quaternary ammonium compound is present in an amount of from 0.1–5% by weight based on the total weight of the concentrate.

5. The composition according to claim 1 wherein:

the said anionic surface active agent is capable of forming a water insoluble or poorly water miscible complex with the said quaternary ammonium compound which complex is miscible or soluble in water in the further presence of a solubilizing effective amount of the surfactant compatibilizing agent.

6. The composition according to claim 1 wherein:

the anionic carboxylated alcohol alkoxylate surfactant compound according to the following general formula:

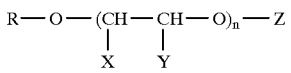

wherein:

R is a hydrophobic $C_6$–$C_{18}$ alkyl group, n is 1–24,

X and Y are independently hydrogen, $CH_3$, succinic acid radical, wherein at least X or Y is a succinic acid radical, and, Z is H.

7. The composition according to claim 1 wherein the anionic carboxylated alcohol alkoxylate surfactant compound is present in an amount of 0.1–5% by weight.

8. The composition according to claim 1 wherein:

the surfactant compatibilizing agent is selected from water soluble salts and amphoteric betaine compounds.

9. The composition according to claim 8 wherein:

the surfactant compatiblizing agent is a water soluble salt selected from NaCl, $MgCl_2$, $NaHCO_3$, $Na_2CO_3$, $NH_4Cl$.

10. The composition according to claim 8 wherein:

the surfactant compatiblizing agent is an amphoteric betaine compound according to the formula:

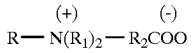

wherein

R is a hydrophobic group selected from: alkyl groups containing from about 10 to about 22 carbon atoms, alkylaryl and arylalkyl groups containing about 10 to about 22 carbon atoms, wherein a benzene ring treated as equivalent to about 2 carbon atoms;

$R_1$ is an alkyl group containing from 1 to about 3 carbon atoms; and, $R_2$ is an alkylene group containing from 1 to about 6 carbon atoms.

11. An aqueous cleaning compositions comprising the aqueous blooming type, hard surface cleaning composition concentrate according to claim 1 dispersed in water in a weight ratio of concentrate:water from 1:0.1 to 1:1000.

12. A composition according to claim 1 which further comprises up to 30% by weight based on the total weight of the cleaning composition one or more nonessential constituents selected from: viscosity modification agents, natural or synthetically produced fragrances, foaming agents, further anionic surfactants, further cationic surfactants, nonionic surfactants, zwitterionic surfactants, amphoteric surfactants, organic solvents, alcohols, glycols, diols, glycol ethers, and coloring agents.

13. A process for treating a hard surface requiring cleaning or disinfection which comprises the step of:

applying the according to claim 1 in an amount effective for providing cleaning and/or disinfecting treatment.

14. A process for treating a hard surface requiring cleaning or disinfection which comprises the step of:

forming an aqueous dilution of the composition according to claim 1 in a larger volume of water, and thereafter, applying the said aqueous dilution in an amount effective for providing cleaning and/or disinfecting treatment.

15. An aqueous blooming type, hard surface cleaning composition concentrate according to claim 1 which comprises per 100% by weight of said concentrate the following essential constituents:

0.1–5% by weight of said cationic quaternary ammonium surfactant;

0.1–5% by weight of said anionic carboxylated alcohol alkoxylate surfactant;

a surfactant compatibilizing agent selected from monovalent alkali earth metal salts, polyvalent alkali earth metal salts, ammonium salts, and amphoteric betaine surfactants; and, water.

16. An aqueous blooming type, hard surface cleaning composition concentrate according to claim 1 which comprises per 100% by weight of said concentrate the following essential constituents:

0.1–4% by weight of said cationic quaternary ammonium surfactant;

0.1–5% by weight of said anionic carboxylated alcohol alkoxylate surfactant;

a surfactant compatibilizing agent selected from monovalent alkali earth metal salts, polyvalent alkali earth metal salts, ammonium salts, and amphoteric betaine surfactants; and, water.

17. An aqueous blooming type, hard surface cleaning composition concentrate according to claim 1 characterized in that when a 5 gram amount of said concentrate is added to 315 grams of water at 20° C. and stirred to form a mixture, the resultant mixture exhibits a light transmittance of 620 nm of less than about 20%.

18. An aqueous blooming type, hard surface cleaning composition concentrate according to claim 17 characterized in that when a 5 gram amount of said concentrate is added to 315 grams of water at 20° C. and stirred to form a mixture, the resultant mixture exhibits a light transmittance of 620 nm of less than about 20%.

* * * * *